US005721520A

United States Patent [19]

McVeety et al.

[11] Patent Number: 5,721,520

[45] Date of Patent: Feb. 24, 1998

[54] CERAMIC FILTER WITH GROUND PLANE FEATURES WHICH PROVIDE TRANSMISSION ZERO AND COUPLING ADJUSTMENT

[75] Inventors: Thomas G. McVeety, Albuquerque; Truc G. N. Hoang, Rio Rancho; David G. Clifford, Jr., Albuquerque, all of N. Mex.

[73] Assignee: Motorola, Inc., Schaumburg, Ill.

[21] Appl. No.: 514,581

[22] Filed: Aug. 14, 1995

[51] Int. Cl.[6] ..... H01P 1/20

[52] U.S. Cl. ..... 333/202; 333/206

[58] Field of Search ..... 333/202, 206, 333/207, 222, 223, 202 DB

[56] References Cited

U.S. PATENT DOCUMENTS

| | | | |
|---|---|---|---|
| 4,937,542 | 6/1990 | Nakatuka | 333/202 |
| 5,146,193 | 9/1992 | Sokola | 333/206 |
| 5,436,602 | 7/1995 | McVeety et al. | 333/206 |

FOREIGN PATENT DOCUMENTS

| | | | |
|---|---|---|---|
| 73501 | 5/1982 | Japan | 333/202 DB |
| 60301 | 2/1990 | Japan | 333/202 DB |

*Primary Examiner*—Benny Lee
*Attorney, Agent, or Firm*—Gary J. Cunningham

[57] ABSTRACT

A ceramic filter (10) is shown and described. The filter (10) has a filter body having top (14), bottom (16), and side surfaces (18, 20, 22 and 24) with through holes (26, 28) extending from the top (14) to the bottom surfaces (16) defining resonators. The surfaces are substantially covered with a conductive material defining a metallized layer, with the exception that the top surface (14) is substantially uncoated, and with an additional exception that a portion of a side surface is substantially uncoated in proximity to the top surface (14) and extending at least in proximity to between the resonators (26, 28), defining an unmetallized coupling region for electrically coupling the resonators. The filter (10) also has first and second input-output pads (34, 38) on a side surface for facilitating connection to a circuit board, for example.

15 Claims, 3 Drawing Sheets

CERAMIC FILTER WITH GROUND PLANE FEATURES WHICH PROVIDE TRANSMISSION ZERO AND COUPLING ADJUSTMENT

FIELD OF THE INVENTION

This invention relates to dielectric ceramic block filters having a plurality of resonators and more particularly to a ceramic filter with ground plane features which provide transmission zero and coupling adjustment.

BACKGROUND OF THE INVENTION

The use of dielectric block filters to filter an electrical signal about a desired frequency is well known in the art. This is typically accomplished by placing a plurality of resonator holes through the dielectric block and coupling these resonators so as to pass desired frequencies and stop undesired frequencies.

Depending upon the specific application and intended use, the filter must be designed to provide a specific frequency response. In addition requiring that the filter have a predetermined center frequency, other parameters such as a specific bandwidth, stopband, insertion loss, and return loss may be specified.

To meet increasingly demanding specifications, designers look for new ways to maximize electrical properties while maintaining a simple filter implementation. A designer has only a few variables with which to work with in order to meet these demanding specifications. One option is to improve the Q of the material from which the filter is made. Another option is to place an additional hole in the dielectric block with the intent of either creating an additional resonator or providing another shunt zero. A zero defines a notch response in the transfer function characteristic of the filter. This option typically will require a larger block resulting in greater volume. Still another option involves screen printing the top surfaces of the filters with a top print pattern. However, top print patterns require increasingly intricate artwork and, as filter size decreases, registration of this artwork becomes difficult.

The present invention introduces a new option for the designer. By changing the metallization on the surface of the block, numerous design goals can be accomplished at the same time.

Inter-resonator coupling helps to create and define the passband. The present invention offers another method of increasing inter-resonator coupling which is especially suited for smaller filters having simple designs, and is an improvement over the prior art.

In addition to creating a specified passband, another design specification that is often simultaneously required is a specified attenuation in the filter response curve. Attenuation is a measure of the filter's selectivity at a predetermined frequency. A filter's selectivity slope is a function of the number of resonators in the filter block. Typically, as the number of resonators increases, the filter's selectivity slope becomes steeper in the region outside the passband. As the filter's selectivity slope becomes steeper in the region outside the passband, the attenuation will increase resulting in a greater attenuating effect on the undesired frequencies. Unfortunately, increased attenuation Often comes at the expense of a narrower passband with a greater passband insertion loss, a more complex filter design, or a larger sized block. Thus, a filter which offers greater attenuation in the form of an additional zero without a corresponding tradeoff of other properties would also be considered an improvement over the prior art.

The coupling of the resonators helps to define the placement of the zeros in a frequency response. These zeros may be moved above or below the passband as required to meet design specifications. The present invention allows for adjustment of the electric field coupling between adjacent and non-adjacent resonators and can introduce a metallized coupling pad which creates a distinct extra zero response.

DETAILED DESCRIPTION OF THE PREFERRED EMBODIMENT

Figure 1:
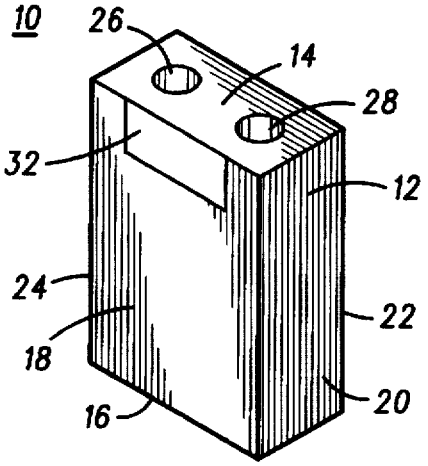
FIG. 1 is a rear perspective view of a two-pole ceramic block filter with an unmetallized coupling region, in accordance with the present invention.

In FIG. 1, a ceramic filter is shown which has a passband for passing a desired frequency, and a transmission zero on the low side of the passband. The ceramic filter 10, includes a filter body 12 having a block of dielectric material and having top and bottom surfaces 14 and 16, and side surfaces 18, 20, 22, and 24. The filter body 12 has a plurality of through-holes extending from the top to the bottom surface 14 to 16, defining resonators 26 and 28. The surfaces 16, 18, 20, 22 and 24 are substantially covered with a conductive material defining a metallized exterior layer, with the exception that the top surface 14 is substantially uncoated comprising the dielectric material and with an additional exception that a portion of the side surface is substantially uncoated comprising the dielectric material in proximity to the top surface 14 of the block and extending at least in proximity to between the resonators, defining an unmetallized coupling region 32 for electrically coupling the resonators.

Figure 2:
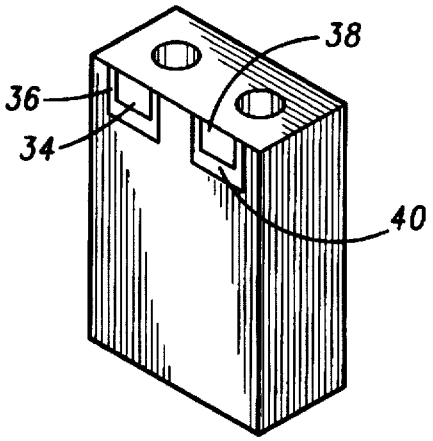
FIG. 2 is a front perspective view of the ceramic block filter of FIG. 1, in accordance with the present invention.

Referring to FIG. 2, the ceramic filter 10 also includes first and second input-output pads 34 and 38 comprising an area of conductive material on at least one of the side surfaces and substantially surrounded by at least one or more uncoated areas 36 and 40 of the dielectric material.

Figure 3:
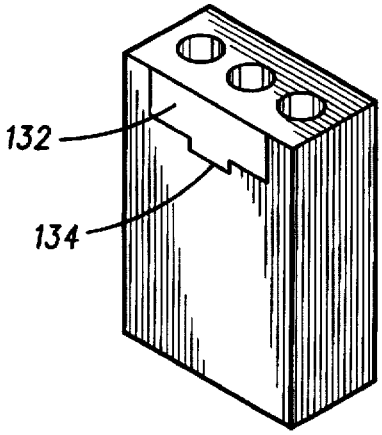
FIG. 3 is a rear perspective view of a three-pole ceramic block filter with an unmetallized coupling region, in accordance with the present invention.
Figure 4:
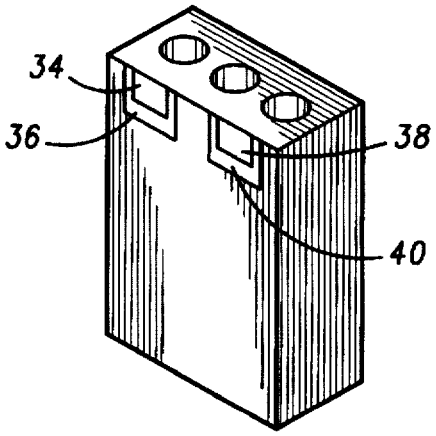
FIG. 4 is a front perspective view of the ceramic block filter of FIGS. 3, in accordance with the present invention.

FIGS. 3 and 4 show another embodiment applied to a three pole ceramic block filter. When the present invention is applied to a three pole filter, the center resonator has a slightly lower frequency due to a greater capacitance. Consequently, in other embodiments of the present invention, a small lip 134 of metallization may be removed from the unmetallized coupling region 132. This additional region of unmetallized dielectric on the side surface of the block removes some of the capacitance and allows the center resonator to have its frequency shifted slightly higher to become more or less equal to the other two resonators. This can be accomplished without additional tuning. Furthermore, the addition of the small lip does not change the substantially rectangular shape Of the unmetallized coupling region 132.

Figure 7:
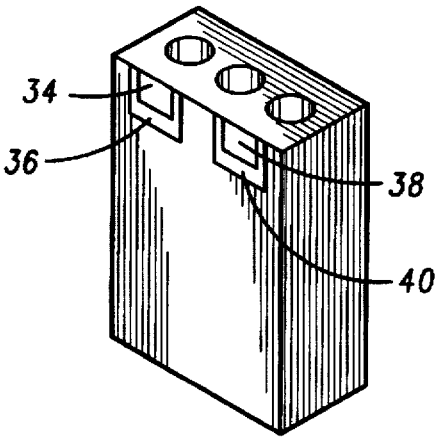
FIG. 7 is a front perspective view of the ceramic block filter of FIG. 6, in accordance with the present invention.
Figure 10:
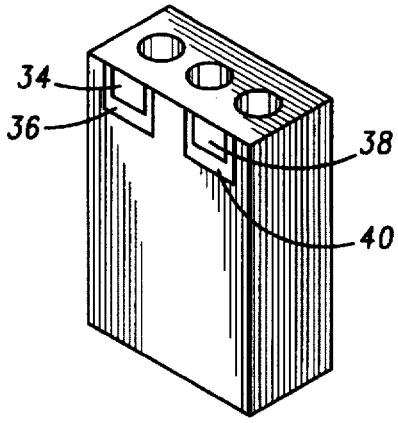
FIG. 10 is a front view of the ceramic block filter of FIG. 9, in accordance with the present invention.
Figure 14:
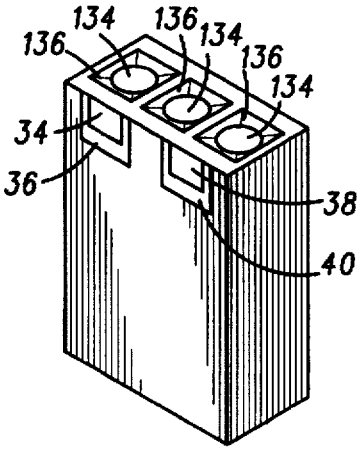
FIG. 14 is a front view of the ceramic block filter of FIG. 13, in accordance with the present invention.

Referring to FIG. 4, the ceramic filter also includes first and second input-output pads 34 and 38 comprising an area of conductive material on at least one of the side surfaces and being substantially surrounded by at least one or more uncoated areas 36 and 40 of the dielectric material. FIGS. 7, 10 and 14 have the same reference numbers as those detailed above with respect to FIG. 4.

Figure 5:
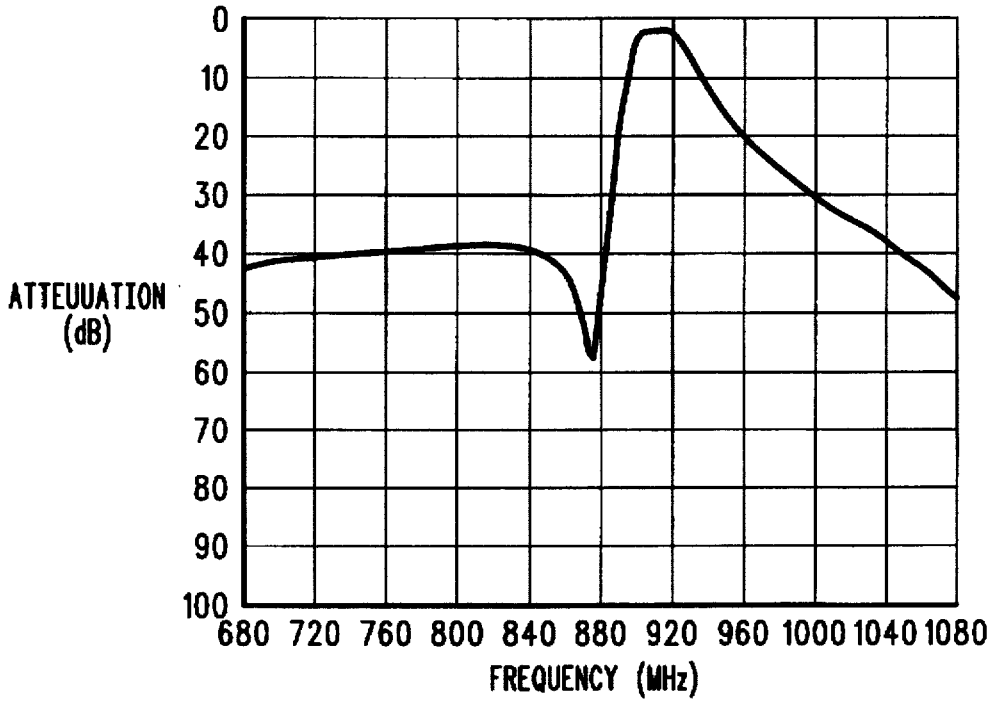
FIG. 5 is a graph of the frequency response curve for the three-pole filter of FIGS. 3 and 4, in accordance with the present invention.

By removing metallization from the side surface of the block, a filter can be created which has a definite frequency response curve as is shown in FIG. 5. FIG. 5 shows a plot of the attenuation in decibels (dB) versus frequency in Mega-Hertz (MHz) for the filter shown in FIGS. 3 and 4. Although other filters duplicate the same response by the use of top metallization or chamfering, the present invention achieves this result by controlling the metallization pattern on the side surfaces of the block.

WORKING EXAMPLE 1

A three pole Neodymium ceramic block filter as shown in FIGS. 3 and 4 were made (without the lip 134), having a dielectric constant of about 82.4. A frequency response curve similar to the one shown in FIG. 5 can be achieved. If the block is about 375 mils in length and about 450 mils in width and about 170 mils in height, a rectangular unmetallized coupling region about 220 mils wide and about 60 mils deep may be created on the side surface of the block in proximity to the top surface of the block. This will create a filter response curve which has a center frequency of about 912.7 MHz and a 3 dB bandwidth of about 28.0 MHz.

The advantages of creating a filter response curve in this manner are numerous. The trend in the industry is for filtering components which are smaller in size and contain less surface area. This necessitates simpler filter designs such as those proposed by the present invention. Although other techniques such as chamfering may be employed to achieve a similar filter response, the tooling for chamfered components is both expensive and difficult to produce. The present invention contemplates simple tooling which is comparatively inexpensive and easier to produce.

Top printing is another technique to achieve a similar filter response. Top printing, however, may require intricate artwork which is difficult to produce in a repeatable manner. Additionally, since top prints are usually applied by a screen printing operation, the registration of the smaller, more detailed components creates additional problems. The present invention eliminates the need to top print the dielectric block thereby eliminating at least one manufacturing step.

The present invention provides a method of achieving the same results with a great savings in time, cost, and ease of manufacture. Whereas other methods of controlling the inter-resonator coupling create additional manufacturing steps and problems, the present invention can reduce the number of manufacturing steps and can provide a manufacturing process which has greater output and repeatability due to simpler filter designs and geometries.

The present invention offers another manufacturing advantage in the form of greater flexibility in the manufacturing process. By using the side metallization processes taught by the present invention, a generic three-pole dielectric filter with predetermined dimensions can be produced en mass, then specific filter response curves can be created by simply changing the mask patterns which are used during the metallization processing step. As a result, many custom filters can be created from a uniform predetermined block of ceramic resulting in less inventory and improved manufacturing processes.

Figure 6:
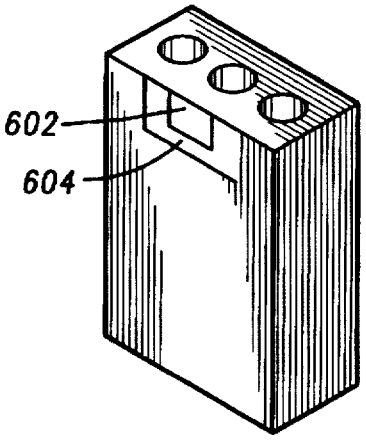
FIG. 6 is a rear perspective view of an embodiment of a three-pole ceramic block filter which contains a metallized coupling pad in an unmetallized coupling region in accordance with the present invention.
Figure 9:
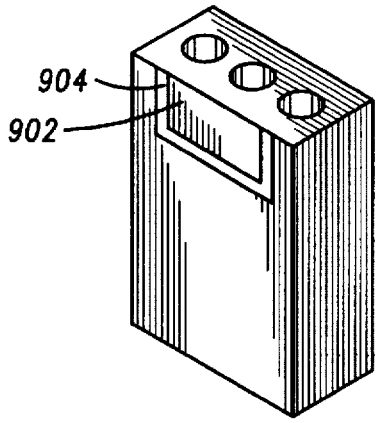
FIG. 9 is a rear perspective view of another embodiment of a three-pole ceramic block filter which contains a metallized coupling pad in an unmetallized coupling region, in accordance with the present invention.

FIGS. 6 and 9 show two embodiments of the present invention in which a metallized coupling pad 602 and 902 is placed inside the unmetallized coupling region 604 and 904, respectively. As will be discussed below, the introduction of the metallized coupling pad creates additional desirable filtering properties. As will also be discussed below, the present invention contemplates that the size and shape of this metallized coupling pad can be used as a design tool to effect the final shape of the filter's frequency response curve.

FIG. 6 is a rear perspective view of an embodiment of a three pole ceramic block filter which contains a metallized coupling pad in the unmetallized coupling region. FIG. 7 shows a front perspective view of the ceramic block filter of FIG. 6. An advantage of keeping metallization in part of the unmetallized coupling region is to gain an additional zero, which provides improved and additional attenuation. This is clearly shown in FIG. 8 which shows a graph of the frequency response curve for the filter in FIG. 6. The significance of this additional zero as a design tool cannot be understated. Most three-pole block filters in the industry have two zeros. The present invention, however, offers a three pole filter with three zeros (the deepest null is actually two zeros at a similar frequency). Thus, the present invention offers improved electrical properties and design advantages while maintaining the same size package as other filters in the industry.

The additional zero can be used as a design tool to shape multiple filter responses. The additional zero can be brought closer to the passband, or it can provide for a wider stopband or wider rejection bandwidth.

The present invention also offers many advantages in the area of filter tuning. With the present invention, only the side void needs to be tuned. This results in a filter which is easier to tune than a filter with an intricate top pattern which may require multiple tuning sites. Additionally, the filter of the present invention can be tuned without having to enter the resonator holes with a tuning element. Thus, the filter can be tuned more quickly leading to greater output in production.

When a metallized coupling pad remains in the unmetallized coupling region, additional tuning benefits are realized. First, the present invention is less sensitive than artwork to process variation. Since the geometry and the pattern of the filter is less intricate, the tuning step is easier to perform. Also, as the embodiment of the present invention with the metallized coupling pad (as shown in FIGS. 6 and 9) is tuned, the zeros change but the passband remains substantially intact. This will further simplify the tuning operation by reducing the inherent change in the filter response curve that accompanies any tuning operation.

A filter which places a metallized coupling pad inside the unmetallized coupling region is provided as a working example number two. This filter is substantially similar to the filter shown in FIG. 6 with its corresponding filter response curve as shown in FIG. 8.

WORKING EXAMPLE TWO

Figure 8:
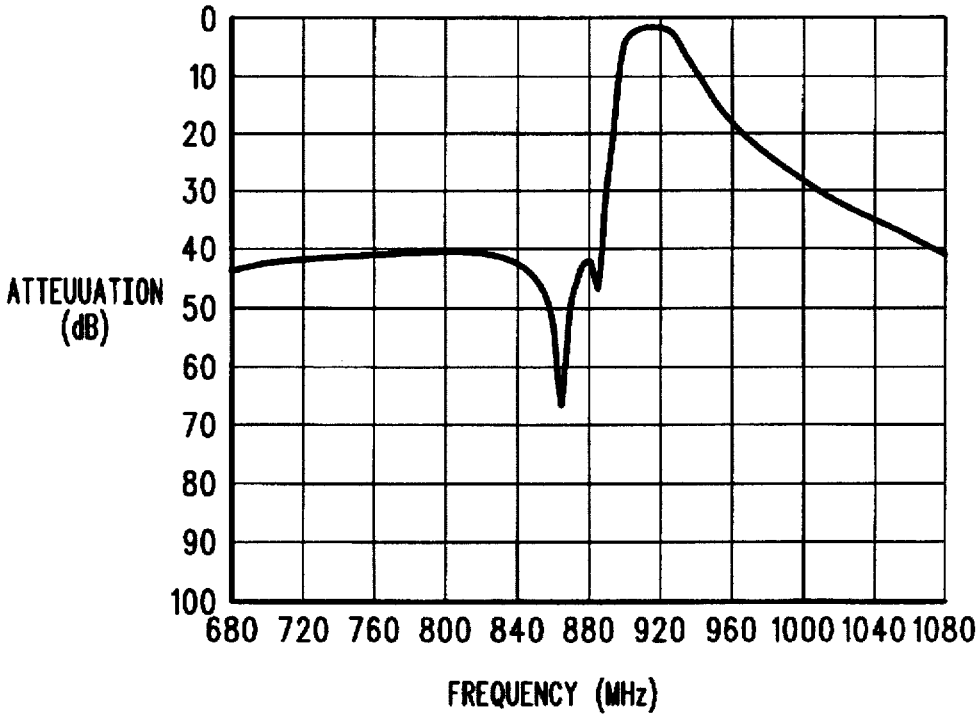
FIG. 8 is a graph of the frequency response curve for the three-pole filter of FIGS. 6 and 7, in accordance with the present invention.

When the present invention is applied to a three pole Neodymium ceramic block filter (shown in FIGS. 6 and 7) having a dielectric constant of about 82.4, a frequency response curve similar to the one shown in FIG. 8 can be achieved. The block was about 375 mils in length and about 450 mils in width and about 170 mils in height. A rectangular unmetallized coupling region about 245 mils wide and about 90 mils deep may be created on the side surface of the block in proximity to the top surface of the block (similar to as shown in FIG. 6). Additionally, a metallized coupling pad about 125 mils wide by about 50 mils deep was placed in the unmetallized coupling region. This creates a filter response curve which has a center frequency of about 919.5 MHz and a 3 dB bandwidth of about 31.2 MHz. Also, this filter response will exhibit a split zero on the low side of the passband.

Figure 11:
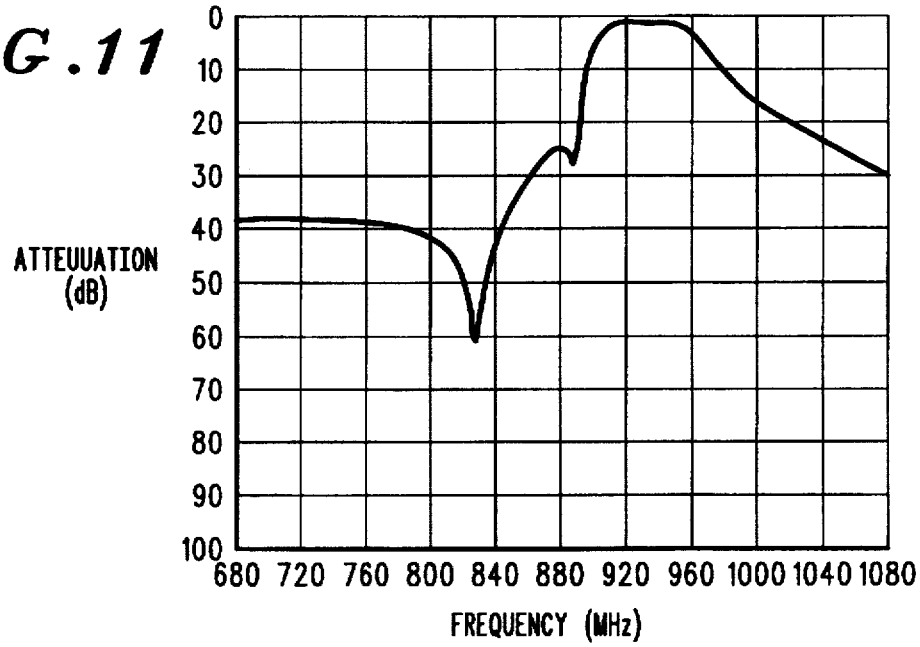
FIG. 11 is a graph of the frequency response curve for the three-pole filter of FIGS. 9 and 10, in accordance with the present invention.

FIG. 9 shows a rear perspective view of another embodiment of a three pole ceramic block filter which contains a metallized coupling pad. FIG. 10 is a front perspective view of the ceramic block filter of FIG. 9. And, FIG. 11 shows a graph of the frequency response curve for the three pole filter of FIGS. 9 and 10.

When the two embodiments of the filter with the metallized coupling pad in the unmetallized coupling region are compared to each other, the significance of the size and the shape of the metallized coupling region can be fully appreciated. Two design rules become readily apparent. First, as the area of the metallized coupling pad increases, the passband widens. FIG. 6, with a relatively small metallized coupling pad, has a corresponding passband of approximately only one (horizontal) block on the plot shown in FIG. 8. FIG. 9, on the other hand, has a relatively large metallized coupling pad and a corresponding wide passband in FIG. 11. The passband in FIG. 11 is approximately twice the width (or approximately two blocks on the plot) of the passband in FIG. 8. The converse is also true. As the area of the metallized coupling pad decreases, the passband contracts.

The second design rule taught by the present invention is equally important. As the metallized coupling pad width increases, the zeros pull apart. The converse is also true. As the pad width decreases, the zeros move closer together on the frequency response curve. This can also be seen by comparing the graphs in FIGS. 8 and 11. The filter that corresponds with FIG. 8 has a very small and narrow metallized coupling pad. As a result, the zeros in FIG. 8 are close together. The filter that corresponds with FIG. 11 has a metallized coupling pad that is both wide and large. As a result, the zeros are much further apart in FIG. 11.

By placing a metallized coupling pad in the unmetallized coupling region, attenuation is improved significantly. This can best be seen by comparing FIG. 5 (graph of a filter with no coupling pad) to FIG. 8 (graph of a filter that does contain a coupling pad). When these two graphs are compared, two major differences can be seen relative to the attenuation in the filter frequency response curves. First, the filter with a metallized coupling pad, FIG. 8, has a minimis point which is noticeably lower than the minimis point of the filter without the metallized coupling pad, FIG. 5. In a working model, this can correspond to a greater attenuation of approximately 10 dB–15 dB. Thus, by adding a zero with the metallized coupling pad, attenuation is greatly improved. Also, the width of the rejection band or the stopband is significantly greater for the filter having the metallized coupling pad. The width of the stopband in FIG. 5 is less than one block on the plot whereas the width of the stopband in FIG. 8 is greater than one block on the plot. The metallized coupling pad, therefore, creates a split zero filter response which results in a wider stopband (rejection band) and a greater attenuation.

Filters with greater attenuation and wider stopbands are very useful in the telecommunications industry. Often, in telecommunications equipment such as a cellular telephone, the offending nearby signal which must be filtered is a transmit or a receive signal. Unfortunately, these signals may be very close to each other on the RF spectrum. Thus, the ability to create a large stopband or increase attenuation in a filter may prove to be a very useful and necessary design tool. The present invention introduces a simple geometry that provides improved and additional attenuation.

Referring to FIG. 11, the present invention also provides for design flexibility in the slope of the attenuation curve. The filter which corresponds with FIG. 11 has a very wide metallized coupling pad. As detailed previously, this will result in the zeros being pulled very far apart on the filter's frequency response curve. This is desirable from a design perspective because when one zero is placed close to the passband, the overall slope of the attenuation curve remains fairly steep, while at the same time, the passband retains its initial desirable shape. Thus, a filter response curve with a steep low side skirt and a wide passband can be achieved in accordance with the present invention. This is shown by working example number three which is similar to the filter shown in FIGS. 9–11.

WORKING EXAMPLE THREE

When the present invention is applied to a three pole Neodymium ceramic block filter having a dielectric constant of about 82.4, a frequency response curve similar to the one shown in FIG. 11 can be achieved. If the block is about 375 mils in length and about 450 mils in width and about 170 mils in height, a rectangular unmetallized coupling region about 290 mils wide and about 150 mils deep may be created on the side surface of the block in proximity to the top surface of the block.

Additionally, a metallized coupling pad about 210 mils wide and about 110 mils deep is placed inside the unmetallized coupling region. This will create a filter response curve which has a center frequency of about 932.3 MHz and a 3 dB bandwidth of about 59.1 MHz. Also, this filter will exhibit a split zero on the low side of the passband.

Figure 12:
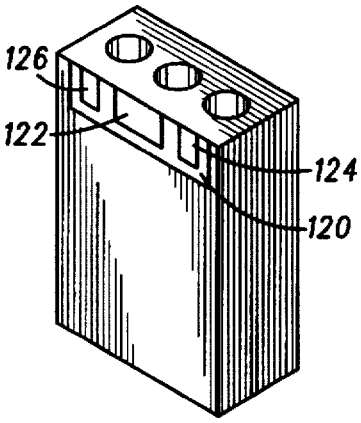
FIG. 12 is a perspective view of an embodiment of a three-pole ceramic block filter with an unmetallized coupling region having a metallized coupling pad and input-output pads on the same side surface of the block, in accordance with the present invention.

FIG. 12 shows an embodiment of a three-pole ceramic block filter in which the unmetallized coupling region 120, the metallized coupling pad 122 and the input-output pads 124 and 126 are all on the same side surface of the block. This is advantageous from a manufacturing point of view because only one side surface needs to be metallized with a pattern. This saves both time and manufacturing steps. Also, there are shielding advantages realized by placing the metallized pattern and the input-output pads on the same side of the filter.

The embodiment in FIG. 12 looks similar to U.S. Pat. No. 5,146,193 to Sokola. However, the embodiment in FIG. 12 is significantly different. In U.S. Pat. No. 5,146,193, one of the purposes of the unmetallized region is to isolate the input-output pads. In the present invention, the purpose of the unmetallized region is to increase the inter-resonator coupling. Also, the metallized region in the present invention is isolated from the rest of the metallization on the rest of the block.

Figure 13:
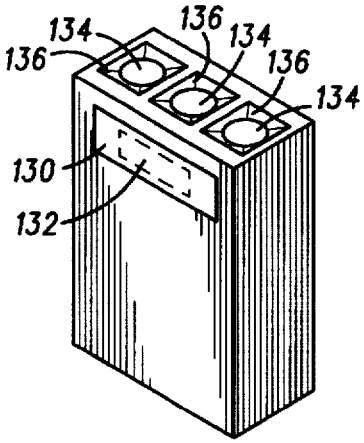
FIG. 13 shows an embodiment with chamfered through-holes of a three-pole ceramic block filter in which the unmetallized coupling region is not immediately connected to the top surface of the block, in accordance with the present invention.

FIG. 13 shows an embodiment of a three-pole ceramic block filter in which the unmetallized coupling region 130 is not immediately connected to the top surface of the block. This provides a design with enhanced flexibility, while staying within scope of the present disclosure. There may also be placed within this unmetallized coupling region, a metallized coupling pattern 132. In FIG. 13, this metallized coupling pad 132 (shown in phantom) is shown as a dashed line inside the unmetallized coupling region 130. In FIGS. 13 and 14, the resonators 134 have chamfers 136 at their top ends.

In a preferred embodiment, the unmetallized coupling region will be substantially rectangular in shape and will occupy the top third of the ceramic block. This geometry results in the working examples described above. Additionally, it is the placement at or near the top end of the filter that this novel method of increasing the interresonator capacitive coupling can best be achieved.

Other embodiments of the present invention may include side metallization patterns in conjunction with chamfered resonators. The combination of these features may together lead to desirable filter characteristics. Filters containing both metallization and chamfering are contemplated by the present invention. An example of a filter having both features is shown in FIGS. 13 and 14. In addition, another embodiment of the present invention may show top artwork patterns used in conjunction with side metallization patterns to achieve desired filter characteristics.

Other embodiments of the present invention may also include more than two or three poles. The technology described in the present invention carries over to four pole and even larger pole structures.

Finally, the present invention may also be applied to other filter structures without departing from the spirit of the present invention. Unique metallization patterns applied to microstrip, stripline, or even multilayer packages would result in substantially similar filter frequency response curves.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A ceramic filter including a passband for passing a desired frequency response and at least one low-side transmission zero, comprising:

a filter body comprising a block of dielectric material and having a top, a bottom surface, and a side surface, and having a plurality of metallized through holes extending from the top to the bottom surfaces defining a plurality of resonators, the bottom and side surfaces being substantially covered with a conductive material defining a metallized layer, with the exception that a portion of the side surface is substantially uncoated comprising the dielectric material in proximity to the top surface defining an unmetallized coupling region and extending substantially horizontally and terminating at outer portions, and the substantially horizontally extending unmetallized coupling region being substantially perpendicular to the metallized through holes such that the outer portions are adjacent and in proximity to two or more of the plurality of resonators, for electrically coupling the resonators to provide the at least one low-side transmission zero, the top surface is substantially uncoated; and first and second input-output pads comprising an area of conductive material on a different portion of the side surface and substantially surrounded by at least one uncoated area of the dielectric material.

2. The filter of claim 1, wherein the unmetallized coupling region and the input-output pads are located on different faces of the side surface.

3. The filter of claim 1 wherein said plurality of resonators have respective chamfers in proximity to the top surface of the filter to facilitate further coupling.

4. A ceramic filter including a passband for passing a desired frequency response and at least one low-side transmission zero, comprising:

(a) a filter body comprising a block of dielectric material and having a top surface, a bottom surface, and a side surface, and having a plurality of metallized through holes extending from the top to the bottom surfaces defining a plurality of resonators, the bottom and side surfaces being substantially covered with a conductive material defining a metallized layer, with the exception that a portion of the side surface is substantially uncoated comprising the dielectric material in proximity to the top surface defining an unmetallized coupling region and extending substantially horizontally and terminating at outer portions and the substantially horizontally extending unmetallized coupling region being substantially perpendicular to the metallized through holes such that the outer portions are adjacent and in proximity to two or more resonators, for electrically coupling the plurality of resonators to provide the at least one low-side transmission zero, the top surface is substantially uncoated;

(b) a metallized pattern contained within said unmetallized coupling region defining a substantially rectangular side component coupling the plurality of resonators in said dielectric block; and (c) first and second input-output pads comprising an area of conductive material on a different portion of the side surface and substantially surrounded by at least one uncoated area of the dielectric material.

5. The filter of claim 4, wherein the unmetallized coupling region and the input-output pads are located on different faces of the side surface.

6. The filter of claim 4 wherein said plurality of resonators have respective chamfers in proximity to the top surface of the filter.

7. A ceramic filter including a passband for passing a desired frequency response and at least one low-side transmission zero, comprising:

a filter body comprising a block of dielectric material having a top surface, a bottom surface, and a side surface, and having a plurality of metallized through holes extending from the top to the bottom surfaces defining a plurality of resonators, the bottom and side surfaces being substantially covered with a conductive material defining a metallized layer, with the exception that a portion of the side surface is substantially uncoated defining a substantially rectangular portion immediately adjacent to a substantially uncoated top surface defining an unmetallized coupling region and extending substantially horizontally and terminating at outer portions and the substantially horizontally extending unmetallized coupling region being substantially perpendicular to the metallized through holes such that the outer portions are adjacent and in proximity to two or more of said plurality of resonators, said unmetallized coupling region being positioned in about a top one-third of the block to provide the at least one low-side transmission zero;

first and second input-output pads comprising an area of conductive material on a different portion of the side surface and substantially surrounded by at least one uncoated area of the dielectric material.

8. The filter of claim 7 wherein a metallized region on said side surface of said block separates said unmetallized coupling region from said substantially unmetallized top surface of said block defining a floating unmetallized coupling region.

9. The filter of claim 7 wherein said plurality of resonators have respective chamfers in proximity to the top surface of the filter.

10. The filter of claim 7 wherein said unmetallized coupling region and said input-output pads are located on a common side surface of said dielectric block.

11. The filter of claim 7 herein a metallized region on said de surface of said block separates said unmetallized coupling region from said substantially unmetallized top surface of said block defining a floating unmetallized coupling region having a metallized coupling pad.

12. A ceramic filter including a passband for passing a desired frequency response and at least one low-side transmission zero, comprising:

a filter body comprising a block of dielectric material having a top surface, a bottom surface, and a side surface, and having a plurality of metallized through holes extending from the top to the bottom surfaces defining a plurality of resonators, the bottom and side surfaces being substantially covered with a conductive material defining a metallized layer, with the exception that a portion of the side surface is substantially uncoated defining a substantially rectangular portion immediately adjacent to a substantially uncoated top surface, defining an unmetallized coupling region, and the unmetallized coupling region extending substantially horizontally and terminating at outer portions, and being substantially perpendicular to the metallized through holes such that the outer portions are adjacent and in proximity to two or more of said plurality of resonators, said unmetallized coupling region being located at about a top third of the block to define the at least one low-side transmission zero;

a metallized coupling pad located within said unmetallized coupling region adjacent to the top surface of the block, said pad electrically isolated from the metallized surfaces of said block; and first and second input-output pads comprising an area of conductive material on a different portion of the side surface and substantially surrounded by at least one uncoated area of the dielectric material.

13. The filter of claim 12 wherein said plurality of resonators have respective chamfers in proximity to the top surface of the filter.

14. The filter of claim 12, wherein said unmetallized coupling region includes said metallized capacitive pad and said input-output pads are located on a common side surface of said dielectric block.

15. The filter of claim 12 wherein a metallized region on the side surface of said block separates said unmetallized coupling region from said substantially unmetallized top surface of the block.

* * * * *